US005962801A

United States Patent [19]

Bowman et al.

[11] Patent Number: 5,962,801

[45] Date of Patent: Oct. 5, 1999

[54] PAGE TURNER

[76] Inventors: Tim Bowman, 3566 Neffs Circle, Salt Lake City; Ben Shepard, Box 501, Ivins, both of Utah

[21] Appl. No.: 09/004,682

[22] Filed: Jan. 8, 1998

[51] Int. Cl.[6] ..... G10G 7/00

[52] U.S. Cl. ..... 84/486; 84/487

[58] Field of Search ..... 84/486–492, 495, 84/500, 503, 510, 511, 513, 515

[56] References Cited

U.S. PATENT DOCUMENTS

| | | | |
|---|---|---|---|
| D. 269,683 | 7/1983 | Barbour | D17/99 |
| D. 275,402 | 9/1984 | O'Brien | D17/99 |
| 989,130 | 4/1911 | Detweller | 84/491 |
| 3,087,268 | 4/1963 | Rice | 40/104 |
| 3,174,242 | 3/1965 | Degorsski et al. | 40/104 |
| 3,217,436 | 11/1965 | Steiert | 40/35 |
| 3,229,344 | 1/1966 | Renquist | 24/252 |
| 3,277,596 | 10/1966 | Shachar | 40/104 |
| 3,281,974 | 11/1966 | Jensen | 40/103 |
| 3,343,776 | 9/1967 | Wieszeck | 248/441 |
| 3,371,571 | 3/1968 | Barbera | 84/502 |
| 3,374,701 | 3/1968 | Wallenberg | 84/521 |
| 3,475,844 | 11/1969 | Shuckichi et al. | 40/104 |
| 3,522,434 | 8/1970 | Varson et al. | 250/208 |
| 3,550,296 | 12/1970 | Castagna | 40/104 |
| 3,570,154 | 3/1971 | Cosenza | 40/35 |
| 3,664,629 | 5/1972 | Reed | 248/445 |
| 3,665,093 | 5/1972 | Machnacz | 84/487 |
| 3,732,773 | 5/1973 | Bombardi | 84/491 |
| 4,040,195 | 8/1977 | Claypool et al. | 40/341 |
| 4,084,468 | 4/1978 | Butler | 84/500 |
| 4,160,334 | 7/1979 | Willis | 40/531 |
| 4,346,641 | 8/1982 | Kobayashi | 84/487 |
| 4,423,659 | 1/1984 | Cassels-Brown | 84/486 |
| 4,644,675 | 2/1987 | Berger et al. | 40/531 |
| 4,719,712 | 1/1988 | Moreau et al. | 40/475 |
| 5,052,266 | 10/1991 | Burster | 84/493 |
| 5,203,248 | 4/1993 | Carr et al. | 84/487 |
| 5,233,900 | 8/1993 | Fitzgerald | 84/497 |
| 5,373,772 | 12/1994 | Shemoul | 84/486 |
| 5,493,943 | 2/1996 | Horikawa | 84/519 |

*Primary Examiner*—William M. Shoop, Jr.
*Assistant Examiner*—Shih-yung Hsieh
*Attorney, Agent, or Firm*—Daniel McCarthy

[57] ABSTRACT

A page turner useful for turning the pages of sheet music and other materials. The preferred page turner has a plurality of page disks located within a housing. Separator disks are sandwiched between page disks. Each page disk has associated with it a page index that is intended to be attached to a page to be turned. Page disks are rotated and pages turned by rotating a cable which has a roller that rotates a page disk. The cable is powered by a foot operated gear drive or an electric motor.

20 Claims, 8 Drawing Sheets

PAGE TURNER

I. BACKGROUND OF INVENTION

A. Field of Invention

The invention relates to the field of devices which may be used to mechanically turn the pages of a musical composition or other work. More particularly, in the most preferred embodiment, the invention is a page turner for musical compositions that utilizes disks indexed to pages of the musical composition so that the pages of the composition may be turned by pressing a remote pedal with one's foot, the pedal causing a cable to turn, the turning of the cable causing a disk to rotate, and rotation of a disk causing the next page in sequence in the musical composition to turn.

B. Prior Art

In the prior art, there have been numerous unsuccessful attempts to provide a reliable and quiet page turner that would be accepted in the market.

U.S. Pat. No. 3,665,093 issued on May 23, 1972 discloses a page turner that uses spring clips secured to pages to be turned, and an electric motor turning a pulley which drives an endless cord to engage the clips and turn the pages. A remote foot switch is provided.

U.S. Pat. No. 3,732,773 issued on May 15, 1973 in the name of Aldo I. Bombardi discloses a page turner that uses vertically disposed wire rods and plastic strips to be placed between pages to be turned. The rods are moved and pages turned by a slidable rack.

U.S. Pat. No. 4,040,196 issued on Aug. 9, 1977 in the names of James P. Claypool and Gerrit Hoogenraad discloses a page turner. The page turner uses a plate with parallel slots for pages of a book to be inserted through and an operable mechanism for selectively moving the slide plate to turn a page. A remote foot switch is provided.

U.S. Pat. No. 4,084,468 issued on Apr. 18, 1978 in the name of Frank M. Butler discloses a page turner. The page turner has an arm that is installed below the page of a book. A biased shaft is secured to the arm to move the arm and cause a page to turn.

U.S. Pat. No. 4,160,334 issued on Jul. 10, 1979 in the name of Gordon Willis discloses a page turner that accommodates forward and backward page turning by using a roller that displaces a page of a book under the roller.

U.S. Pat. No. 4,423,659 issued on Jan. 3, 1984 in the name of Alastair K. Cassels-Brown discloses a page turning device that uses rotating drums, filament wound on the drums, and a biasing mechanism to keep the drums and filaments tensioned and ready to turn pages. The filaments are attached to pages to be turned, and when the filaments are drawn inward by the turning drum, they in turn pull upon the pages to which they are attached, causing them to turn.

U.S. Pat. No. 4,644,675 issued on Feb. 24, 1987 in the names of John G. Berger and David J. Emmons discloses a page turner for books. The page turner includes a support for the book, a power driven disk, a finger that protrudes from the disk to pages of the book, and a power drive. A page curler device is used to curl pages of the book in order for the finger to pull and turn the page at the curl.

U.S. Pat. No. 4,719,712 issued on Jan. 19, 1988 in the names of Jean-Claude A. Moreau and Francois Chaudiere discloses a page turner which is motor controlled and uses a suction tube to lift a page to be turned, and a double acting pusher that turns the pages. A remote actuator is provided.

U.S. Pat. No. 5,052,266 issued on Oct. 1, 1992 in the name of Robert C. Burster discloses a page turner that uses spring-actuated control plates associated with wire page turner elements that effect page turning when controlled by a sequential release mechanism. The device is actuated by a user's foot.

U.S. Pat. No. 5,203,248 issued on Apr. 20, 1993 in the names of Douglas J. Carr and Lincoln Lucero discloses a battery operated page turner that accommodated forward and backward page turning by use of tabs on an endless belt.

U.S. Pat. No. 5,233,900 issued Aug. 10, 1993 in the name of Stephen P. Fitzgerald discloses a music page turner that has a frame and a number of page turner assemblies that each include a disk rotatable on an axle. The disks each have a notch and an arm. The notch in a disk is used to prevent movement of the disk until it is time for the page associated with that disk to be turned. Each arm is attached to a page of music, and a page of music is turned by turning the disk and arm assembly associated with that page of music.

U.S. Pat. No. 5,373,772 issued Dec. 20, 1994 in the name of Elie Shemoul discloses a page turner intended to be used in conjunction with a music stand. The page turner uses a set of springs of predetermined lengths, each spring being connected to a transparency. In turn, each transparency is placed behind a page of music, and when the spring corresponding to a transparency is moved, the page of music corresponding to the transparency is moved. This is a complicated mechanism that makes the composition thick and unwieldy by inserting transparencies into it, and it introduces the noise of turning transparency pages in addition to pages of music.

U.S. Pat. No. 5,493,943 issued Feb. 27, 1996 in the name of Masaaki Horikawa discloses a page turner that holds a book open and mechanically selects and turns a page of the book. Electrical and computer control apparatus are used to operate the page turner.

U.S. Pat. No. Des. 269,683 issued Jul. 12, 1983 in the name of Bruce E. Barbour discloses an electric sheet music page turner having a pair of extending arms, each arm having affixed to it what appears to be a clip for attaching to a page of paper.

U.S. Pat. No. Des. 275,402 issued Sep. 4, 1984 in the name of Gerald T. O'Brien discloses a music book page turner that has five (5) wire arms that appear adapted to be placed between pages of a music book in order to turn them.

The prior art fails to address many problems which are solved by the invention, including providing a nearly silent page turner, providing a page turner that can repeatedly turn only a single page that is the next page in sequence, and providing a page turner that can be reliably actuated by a musician's foot, leaving his hands free to manipulate his instrument.

II. SUMMARY OF INVENTION

It is an object of the invention to provide a page turner which can be used to reliably turn pages of sheet music. It is a feature of the invention that each page of a piece of sheet music may be individually indexed into the page turner apparatus. It is an advantage of the invention that the pages may be singly turned in a positive and reliable manner so that one and only one page is turned at a time.

It is an object of the invention to permit prior indexing of the pages of a book or other documents only once for multiple future uses in a page turner. It is a feature of a preferred embodiment of the invention that page disks can be attached to pages, and thereafter, the page turner can be used to turn those pages using the page disks on any number of future occasions. It is a consequent advantage of the invention that a musician may index a printed musical work once, and then use the invented page turner to turn the pages of the work many times as he or she practices and performs the work.

It is an object of the invention to provide a page turner which can be activated by a musician's foot, leaving the musician's hands free to manipulate his instrument. It is a feature of the invention that a remotely locatable actuation box may be employed to cause the page turner to turn a page of music. It is a consequent advantage of the invention that the musician need not interrupt manipulation of his instrument in order to turn pages of a piece of music.

It is an object of the invention to provide a page turner which turns pages of a piece of music or other work in a nearly silent manner. The physical structures used in the preferred embodiments of the invention keep noise to a minimum and thereby demonstrate significant advantages over page turners in the prior art.

It is an object of the invention to provide a page turner which is inexpensive to manufacture. The invented page turner, if constructed according to the preferred embodiments of the invention, utilizes components that can be mass produced at a very low cost. It is a consequent advantage of the invention that it can be made available to musicians with a variety of budgetary capabilities, from the elementary school student to the concert pianist.

It is an object of the invention to provide a page turner which can be integrated into pianos and music stands at the time of their manufacture. The structures of the invention, including the foot actuator, lend themselves to inclusion in a piano at the time of its manufacture or to retrofitting to existing pianos and music stands. The foot actuator may be installed simply as a fourth pedal on a piano, organ, synthesizer, standing keyboards and other instruments. It is a consequent advantage of the invention that it may be presented to the consumer as an original equipment item rather than as an aftermarket accessory.

Additional objects, features and advantages of the invention will become apparent to persons of ordinary skill in the art upon reading the specification in conjunction with the appended drawings.

III. BRIEF DESCRIPTION OF THE DRAWINGS

FIG. 1 depicts a partial parts explosion view of a page disk housing assembly of the invention with a page disk exposed.

FIG. 1*a* depicts a page disk assembly separate from its housing.

Figure 9:
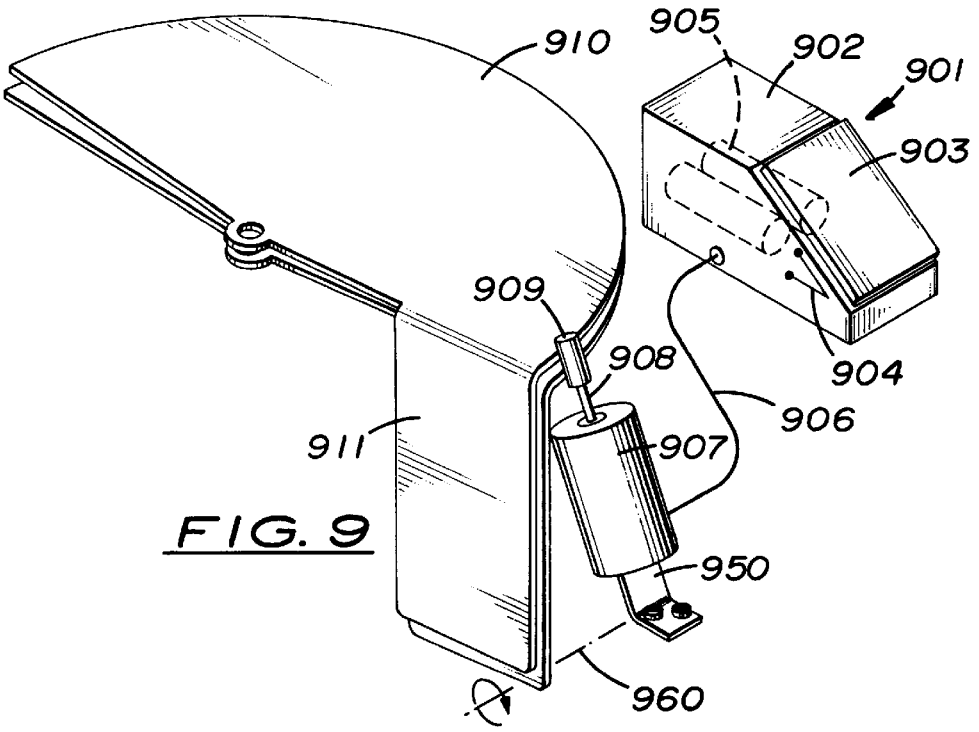
FIG. 9 depicts a perspective view of an alternative actuation and drive mechanism in conjunction with page disks.
Figure 9A:
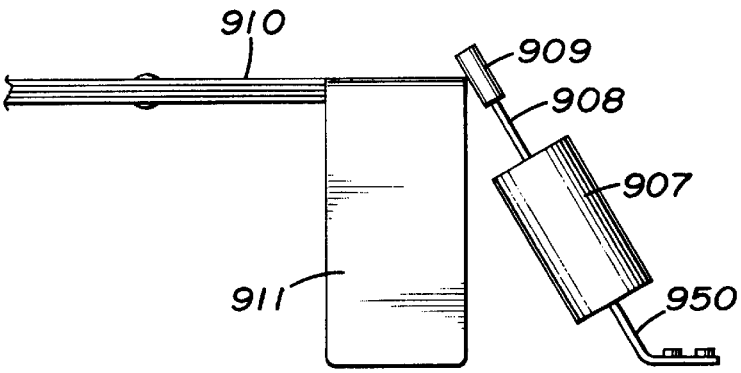

FIG. 9*a* depicts a front view of the embodiment of FIG. 9.

Figure 9B:
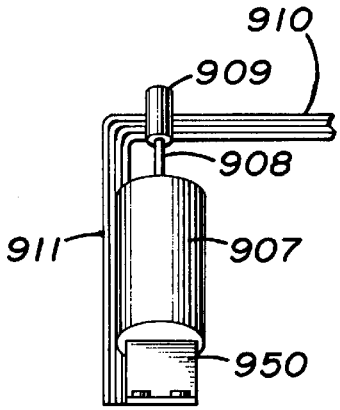

FIG. 9*b* depicts a side view of the embodiment of FIG. 9.

Figure 10:
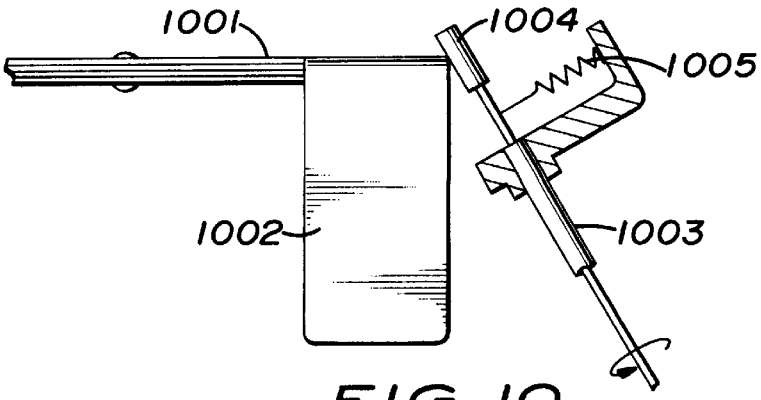

FIG. 10 depicts a front view of an alternative page disk tensioning and roller mechanism.

Figure 11:
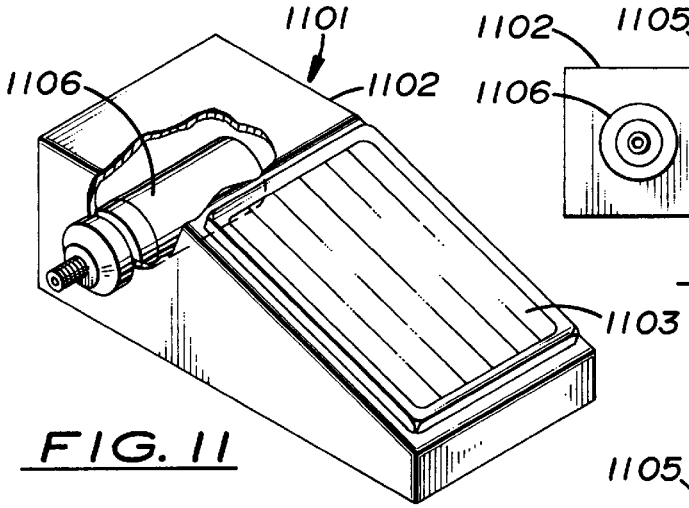

FIG. 11 depicts an alternative electric actuator box of the invention.

Figure 12:
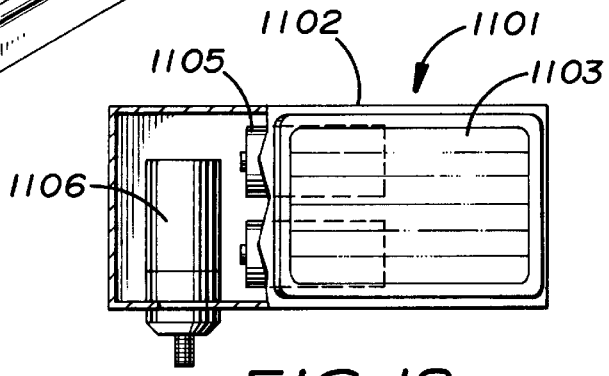

FIG. 12 depicts a top view in phantom of the actuator box of FIG. 11.

Figure 13:
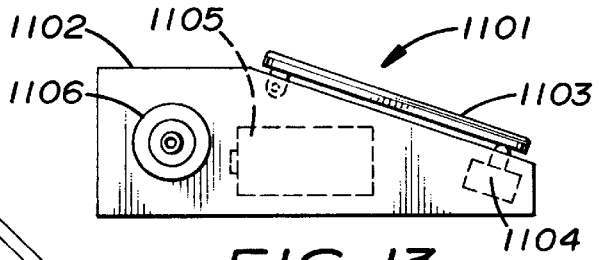

FIG. 13 depicts a side view in phantom of the actuator box of FIGS. 11 & 12.

Figure 14:
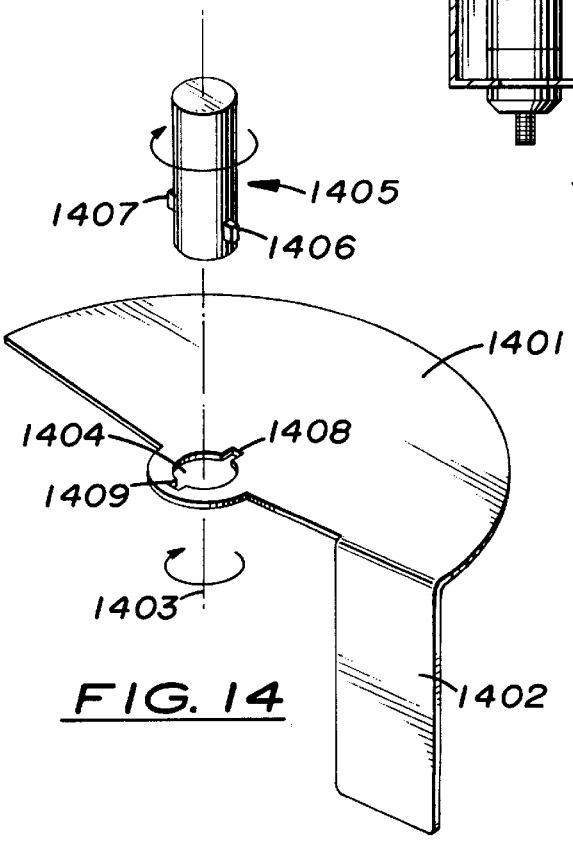

FIG. 14 depicts a page disk with an alternative drive mechanism.

Figure 15:
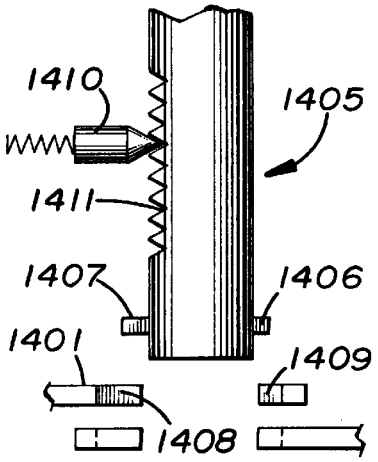

FIG. 15 depicts the drive mechanism of FIG. 14 in greater detail.

IV. DETAILED DESCRIPTION OF THE PREFERRED EMBODIMENTS

Figure 1:
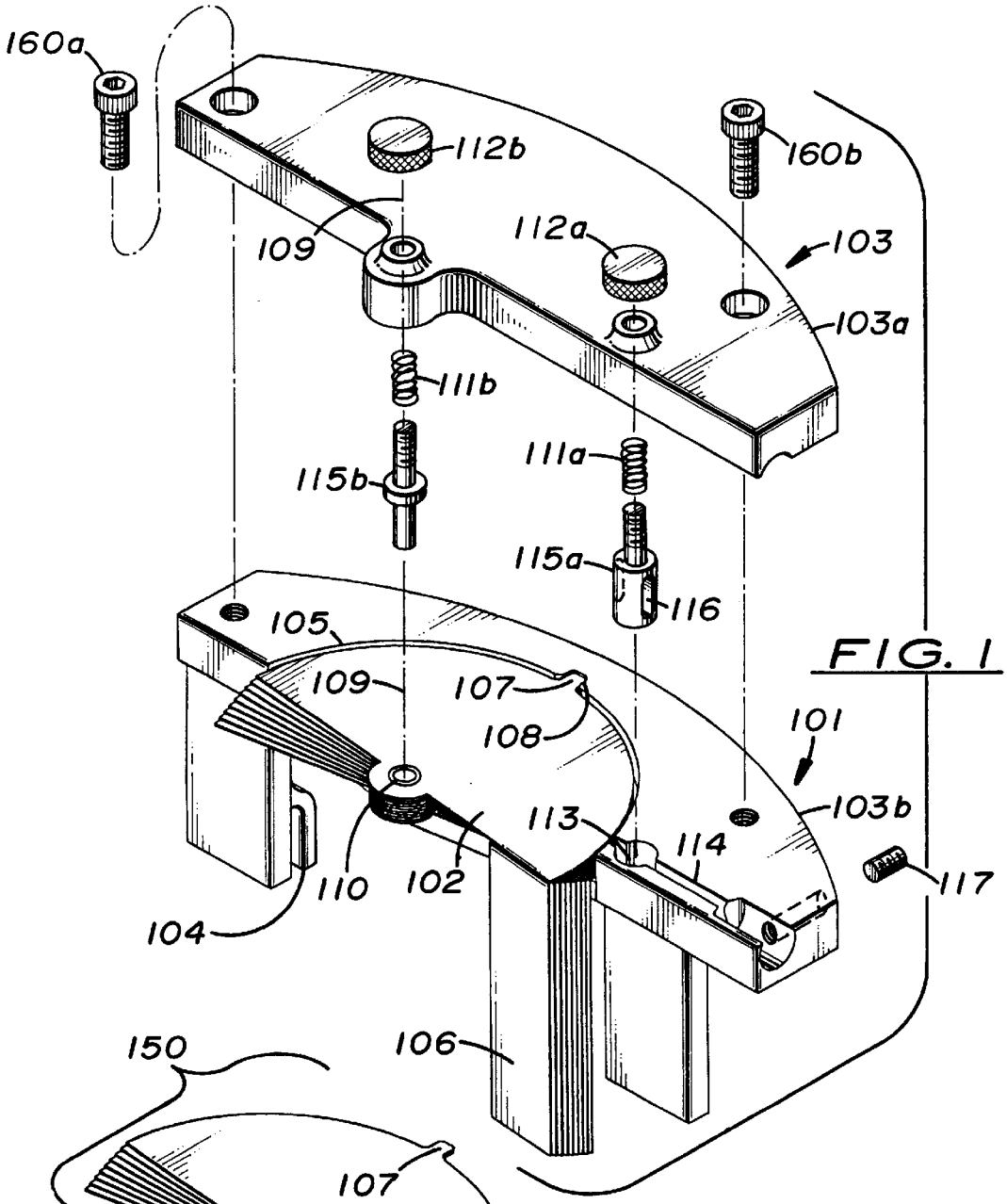
Figure 1A:
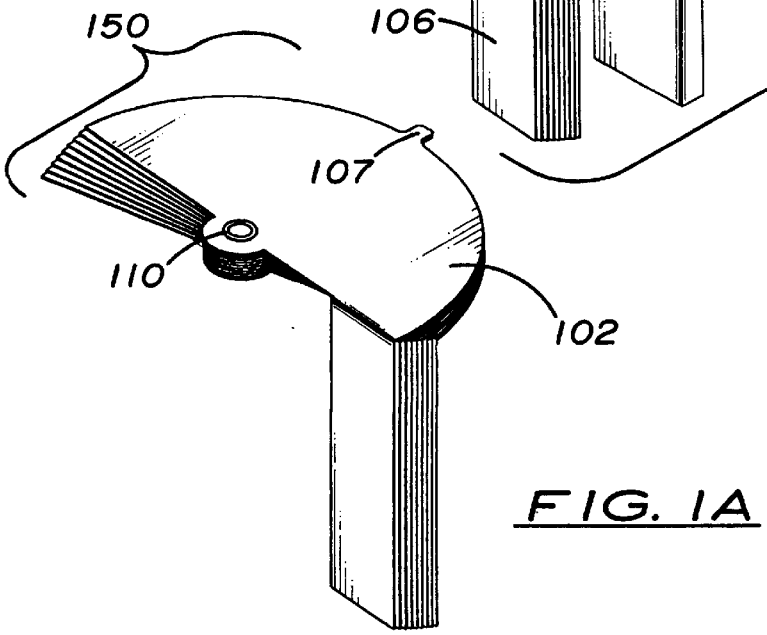
Figure 2:
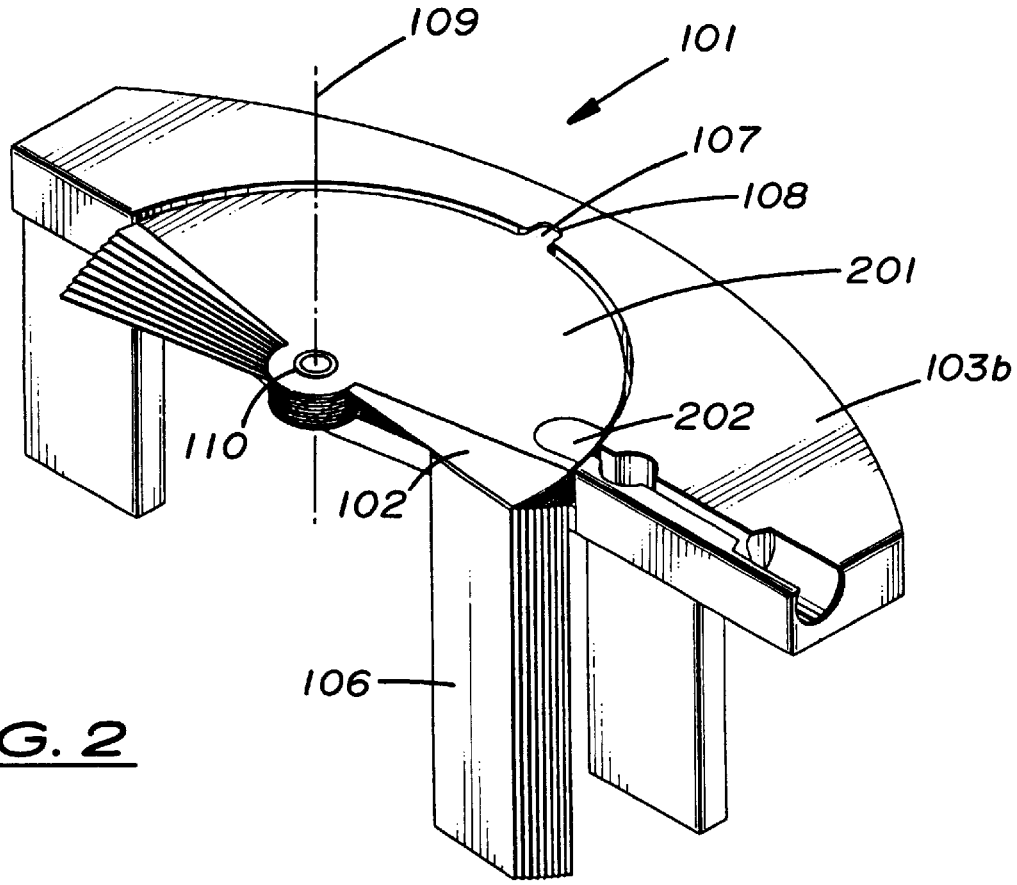
FIG. 2 depicts the page disk housing assembly of FIG. 1 with a separator disk exposed.
Figure 3:
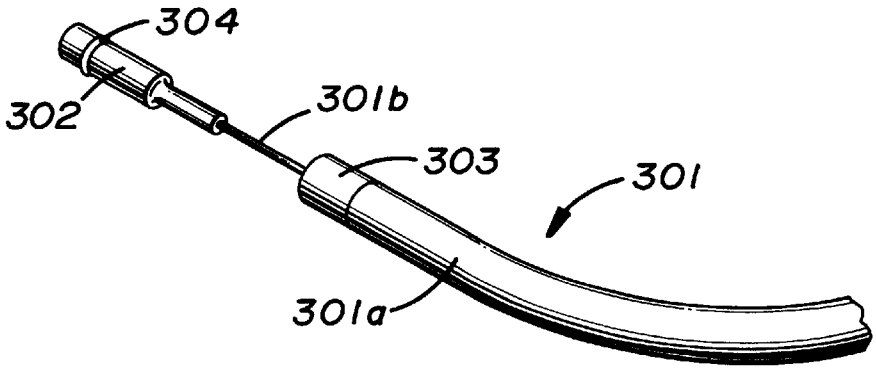
FIG. 3 depicts a cable with a disk roller at its end intended to be used with the page disk assembly of FIGS. 1 and 2.

Referring to FIGS. 1–3, views of a page disk housing assembly 101 with page disks 102 and cable assembly 301 are shown. The assembly 101 includes a housing 103 which includes an upper housing member 103*a* and a lower housing member 103*b*. The housing 103 may include some type of attachment mechanism or clamp 104 to enable it to be attached to a music stand, piano or other stationary apparatus.

The housing 103 (including 103*a* and 103*b*) has a recess 105 within its interior that accommodates page disks 102. The page disks 102 may be made of any suitable material, but polycarbonate is preferred. Page indexes 106 are includes either as an integral part of page disks 102 or as separate structures. Page indexes 106 are each affixed to a page of music to be turned (one page index per physical page of music) by an appropriate mechanism, such as adhesive. Positively indexing one page index to one page of music allows the invention to ensure that rotational movement of a page disk turns one and only one page of music.

Each separator disk 201 includes a peripheral protrusion 107 that protrudes into and secures the separator disk 201 with respect to a slot 108 in the lower housing 103*b*. This prevents the separator disks 201 from turning. The separator disks 201 are not required to turn as they serve as separators between page disks and cannot be rotated by an adjacent page disk. Page disks and separator disks are sandwiched together in alternating fashion so that any two page disks are separated by a separator disk. Each separator disk 201 includes a clearance 202 so that a roller 302 can reach page disks 102 below any particular separator disk 201 without the necessity of turning the separator disk out of the way.

Each page disk 102 rotates with respect to a rotational axis 109 in order to turn pages of music. At the axis 109, the page disks 102 are held together with a suitable fastener, such as a brass rivet or bushing 110.

The housing 103 has two members 103*a* and 103*b* which are preferably held together by two or more fasteners 160, or alternatively by adhesive or other forms of bonding, welding, or snap-assembly. Pin 115*b* protrudes through rivet 110 to hold disk assembly 150 on axis 109. Pin 115*b* and spring 111*b* are mounted in the housing 103 through the axis 109. Pin 115*b* is retained by nut 112*b*, which is used to retract the pin upward to remove and replace disk assembly 150. Spring 111*a* and bolt 115*a* slide vertically in the housing 113 beyond the periphery of the page disks 102 and recess 105 in an enlarged portion 113 of the channel 114 that accommodates the drive cable 301, and is biased downward by spring 111*a*. Knurled nut 112*a* is used to draw bolt 115*a* upward, and along with it, disk roller 302. Nut 112*a* is used in conjunction with nut 112*b*, to allow removal and replacement of disk assembly 150. Bolt 115*a* has a passage 116 through it through which the disk roller 302 may project in order to reach a page disk 102. The channel 114 also has a mounting location for the cable 301 body end 303 to be mounted and secured in by a screw, bolt or spring 117. When assembled in this manner, the disk roller 302 protrudes through the bolt 115*a* so that an o-ring 304 on the roller 302 contacts a page disk 102 at the periphery of the disk 102. Rotational movement of the cable causes the disk roller and o-ring to rotate. As the o-ring firmly contacts a page disk due to action of spring 111*a* and bolt 115*a*, rotation of the cable and o-ring causes the page disk to rotate about the axis 109. In turn, a page affixed to the page index corresponding to that page disk is moved in a rotational manner about the axis 109, it causing to be turned out of the way so that the user can see the next page of music in sequence in the composition that he is playing. When turning is completed, the roller drops through clearance 202 to engage the next page disk. This arrangement ensures that one page at a time is reliably turned. With this embodiment of the invention, 15–20 pages of music are reliably turned.

The page disk housing mounts to a music stand with screws, bolts, adhesive or other commonly known mounting technology. Alternatively, the page disk housing can be built into a music stand or a piano at the time of manufacture.

Figure 4:
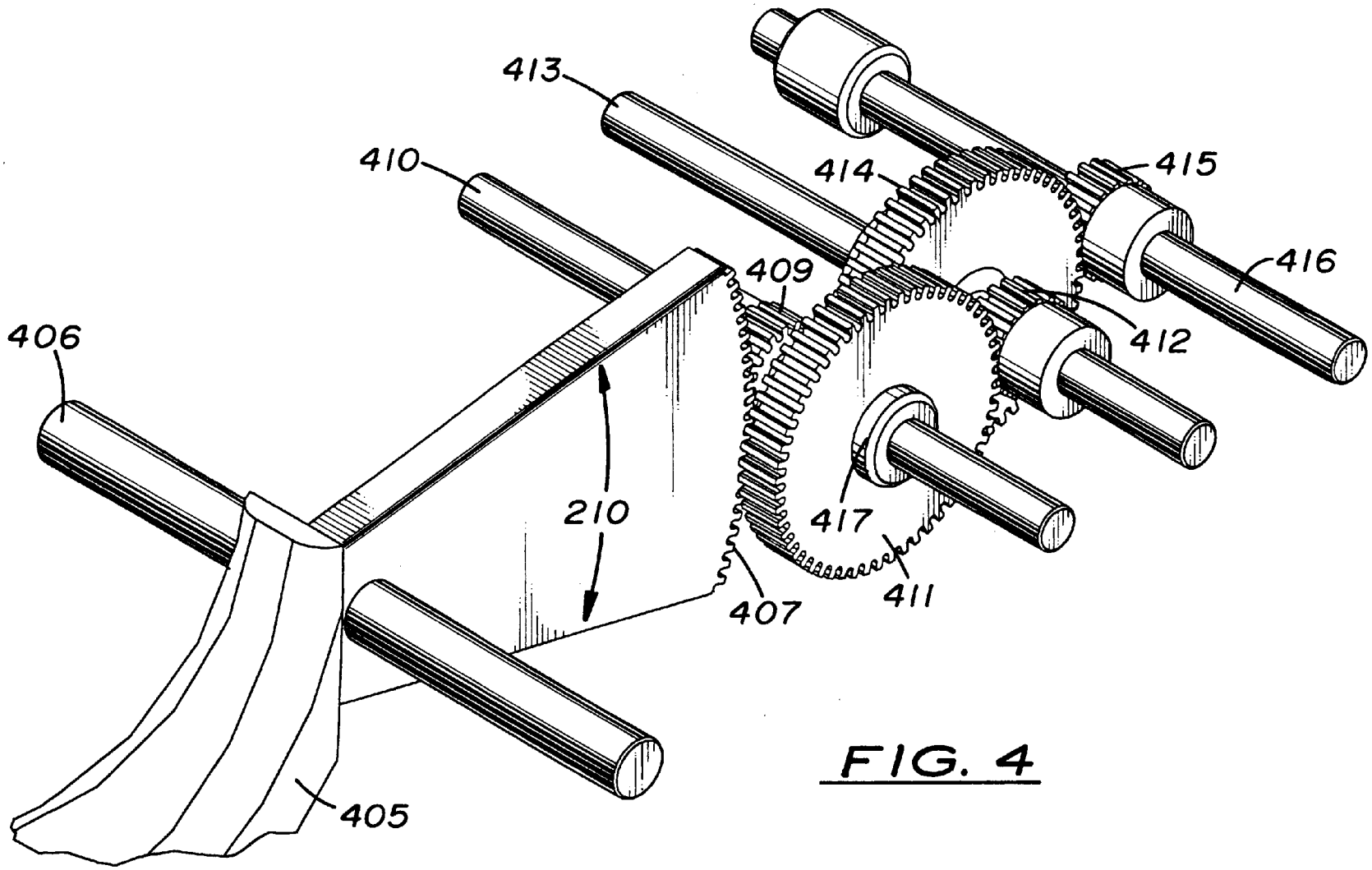
FIG. 4 depicts a pedal and gear drive assembly of the invention used to turn the cable and disk roller of FIG. 3.
Figure 5:
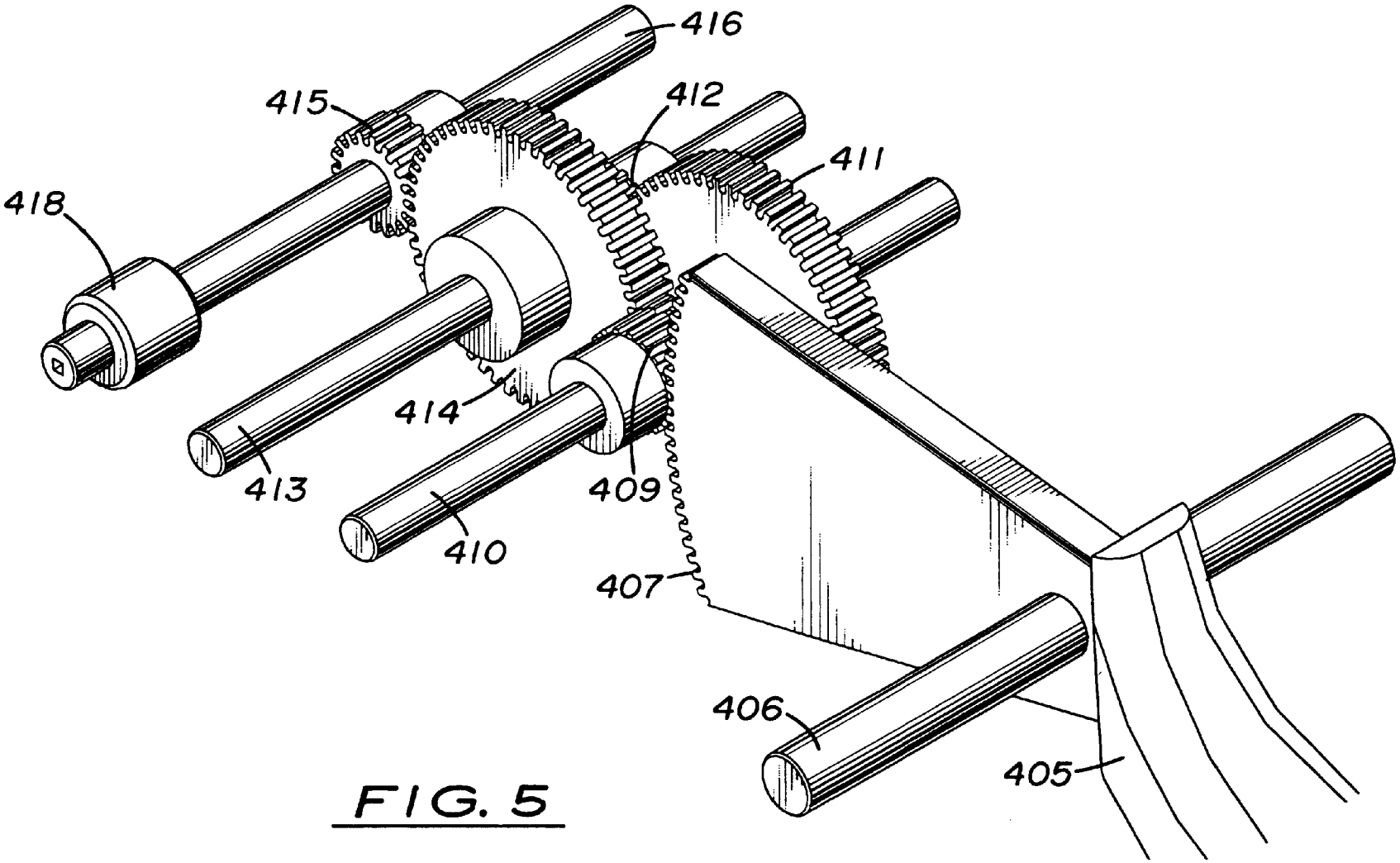
FIG. 5 depicts another view of the pedal and gear drive assembly of FIG. 4.
Figure 6:
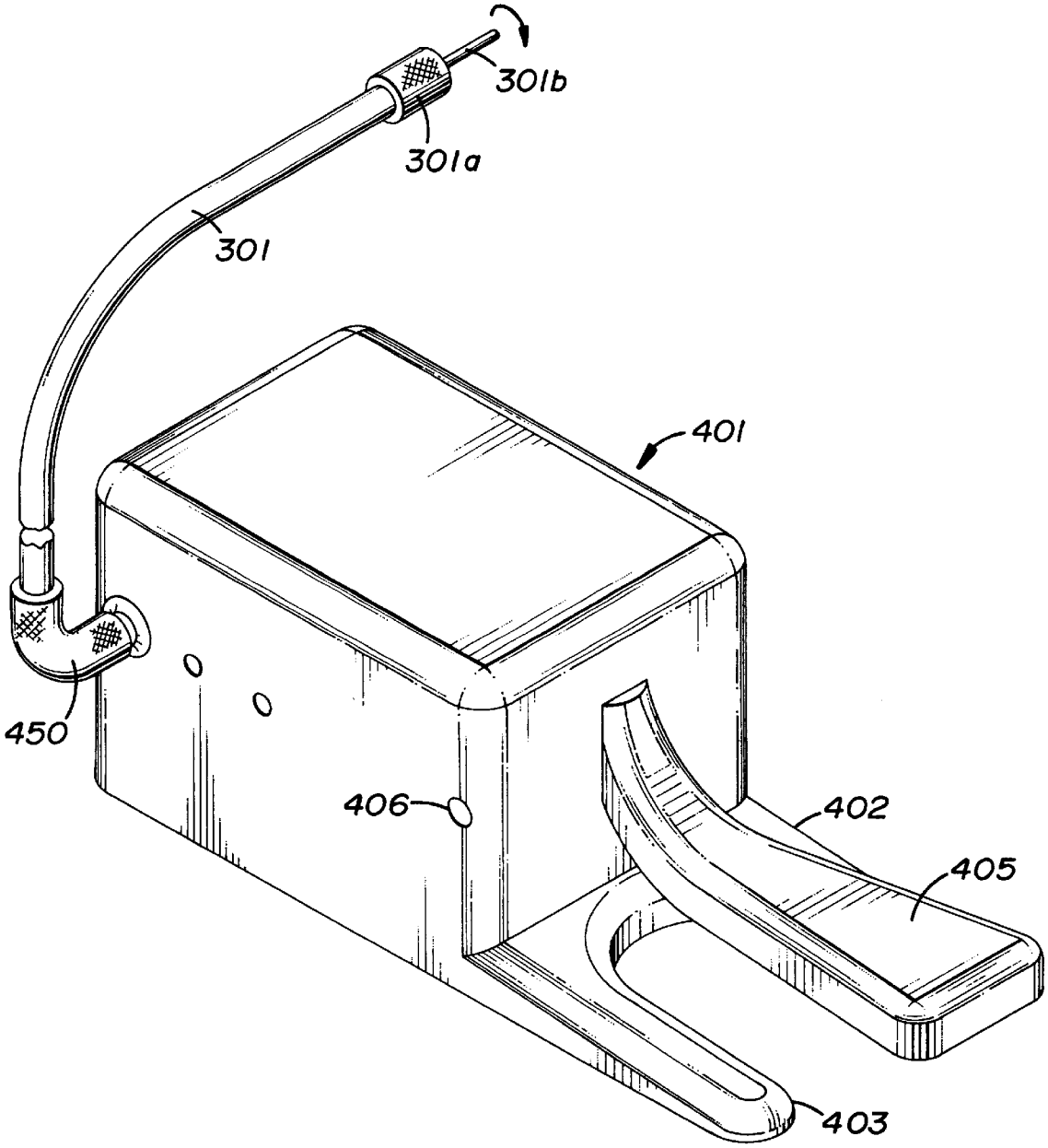
FIG. 6 depicts a housing for the pedal and gear drive assembly of FIGS. 4 & 5.

Referring to FIGS. 4–6, a pedal and gear drive assembly of the invention used to turn the cable and disk roller of FIG. 3 are shown. The assembly includes a housing 401 which includes a pair of feet 402 and 403 for stability. From the housing 401, a cable 301 extends in order to transmit rotational movement to a roller and page disks (not shown). A pedal 405 is provided so that the user may press the pedal 405 once with his foot in order to effect turning of one page of music. When the pedal 405 is pressed, the pedal 405 pivots on a shaft 406 mounted to the housing 401. It is preferred that the pedal 405 have not more than 21 degrees of rotational movement to effect the turning of one page of music, and a 10 degree throw is more preferred. The pivoting motion in turn moves a gear face 407 on the distal side of the pedal 405. This moves the gear face 407 in an upward direction, in turn rotating gear 409 that interfaces with the gear face 407. As gear 409 is affixed to shaft 410, shaft 410 is rotated with gear 409. Gear 411 is also affixed to shaft 410, so it turns as well, and as gear 411 interfaces with gear 412, gear 412 is also turned. Gear 412 is affixed to shaft 413, and gear 414 is affixed to shaft 413, so when gear 412 turns due to pedal actuation, shaft 413 and gear 414 also rotate. Rotation of gear 414 causes rotation of gear 415 with which it interfaces, and as gear 415 is affixed to shaft 416, shaft 416 is caused to rotate as well. Rotation of shaft 416 causes rotation of cable 301 that is attached to shaft 416. Rotation of cable 301 causes the rotation of a page disk and the turning of a page as described above. Preferably, cable 301 will have a plastic housing 301*a* on its exterior that does not rotate, and a metal cable 301*b* on its interior which rotates. Cable housing 301*a* is fixed to housing 401 with a knurled collar 450 to allow the foot pedal to be detached for transportation.

In the gear assembly just described, gear 411 is attached to shaft 410 by use of an appropriate clutch 417, such as a roller clutch, and shaft 416 is attached to housing 401 by an appropriate clutch 418, such as a roller clutch. Use of clutches 417 and 418 allows the pedal 405 and gears to return to their pre-actuated (or resting) positions without unwinding the rotational movement of the cable that was brought about by pressing of the pedal.

It is preferred that a gearset is used that has a gear ratio of 85:1. The housing is preferably made from a heavy material, such as cast zinc, for stability, and the pedal is preferably made from brass for a quality look and feel. The gears are preferably plastic or other inexpensive material. The clutches could be roller clutches, sprague clutches or other clutching mechanisms. The pedal throw and gear ratio should be chosen so that one push of the pedal causes one page of music to turn. In the preferred embodiment, one push of the pedal causes the cable to rotate about its axis five times and one page disk to be turned about 160 degrees. The cable is preferably a unidirectional flexible shaft drive.

Figure 7:
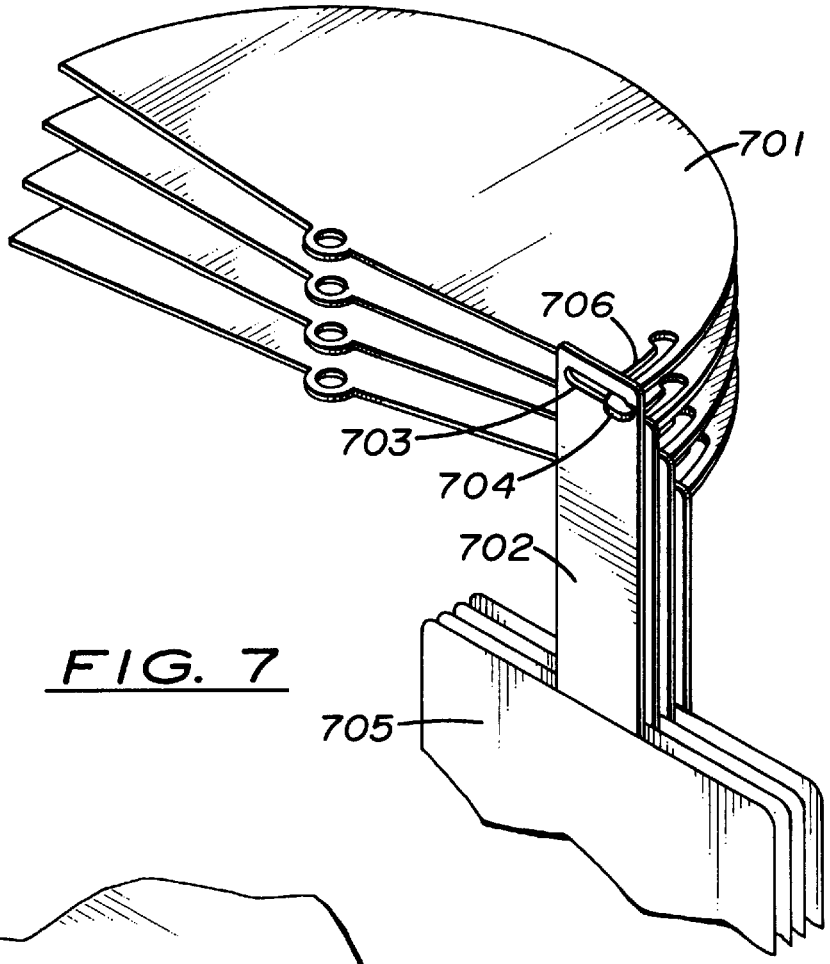
FIG. 7 depicts an alternative page disk assembly useful in the invention.

Referring to FIG. 7, an alternative page disk assembly of the invention is depicted. A page disk 701 is shown in typical semi-circular configuration. The page disk 701 includes a single protruding hook 704 which is spaced apart from the body of the page disk 701 by an alley 706. The hook 704 attaches to a page index (or tab) 702 through a slot 703. The hook 704 has a recess in it to accommodate and firmly hold the page index 702. The page index 702 is attached to a page 705 that is desired to be turned.

Figure 8:
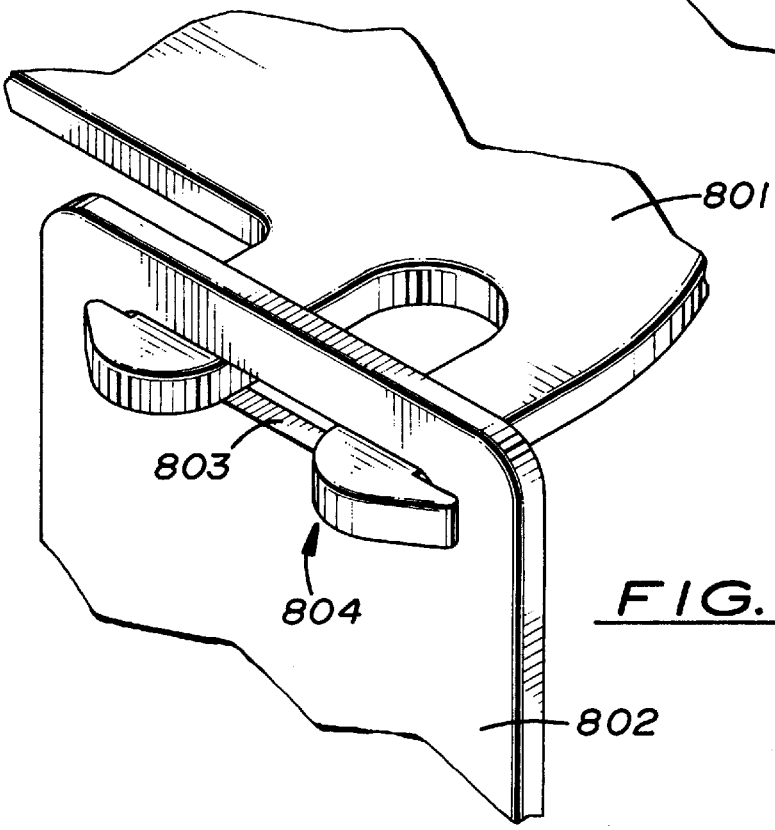
FIG. 8 depicts an alternative attachment mechanism for attaching a page disk to a page index.

Referring to FIG. 8, an alternative page disk and page index attachment mechanism is shown. Depicted is a page disk 801 that includes a pair of protruding hooks 804 which project through a slot 803 on a page index 802 in order to firmly hold the page index and push it about 160 degrees in order to turn a page attached to the page index 802.

Referring to FIGS. 9, 9*a* and 9*b*, an alternative actuation and drive mechanism in conjunction with page disks of the invention are depicted. The embodiment of the invention depicted uses a remote actuator assembly 901 that is intended to be foot-controlled. The actuator assembly 901 includes a housing 902 on which a pedal 903 is mounted. The pedal 903 is used to close the contacts on a switch 904 and cause current from batteries 905 to flow through a wire 906 to an electric motor 907. The motor 907 could be a miniature DC gear motor with ratio selected to turn the page at an appropriate speed. The motor drives a shaft 908 on which is mounted a roller 909. The motor is preferably mounted obliquely on a leaf spring 950, which allows it to rotate about axis 960, and provides force for friction between roller 909 and disk 910. The roller 909 is mounted so that it is in contact with the periphery of a page disk 910 such that when the roller turns, it causes a page disk to rotate about 160 degrees and thereby turn a page of music due to the consequent movement of a page index 911 associated with the page disk 910.

Referring to FIG. 10, a front view of an alternative page disk tensioning and roller mechanism is depicted. The device of FIG. 10 includes page disks 1001 with page indexes 1002. The apparatus that drives or turns the page disks and page indexes is a cable 1003 with a roller end 1004. The roller end 1004 is kept biased against the page disk 1001 by use of a spring 1005 so that firm contact is maintained between the roller end 1004 and the page disk 1001. This is important to ensure that rotational movement of the roller end 1004 causes proportional movement of the page disk 1001.

Referring to FIGS. 11–13, an alternative electric actuator box of the invention is depicted. The actuator box 1101 includes a housing 1102 to which a pedal 1103 is joined. The pedal serves to actuate a switch 1104 which permits electrical current to flow from batteries 1105 to miniature gear motor 1106, causing the motor 1106 to turn. A cable (not shown) is attached to the motor so that when the motor turns the cable also turns. At its distal end, the cable causes a page disk (not shown) to be rotated as described above, resulting in the turning of a page.

Referring to FIGS. 14 & 15, a page disk with an alternative drive mechanism is depicted. Rather than being driven by a roller at its periphery, page disk 1401 with page index 1402 is driven or rotated by a keyed drive located at its axis of rotation 1403. At its axis of rotation 1403, page disk 1401 has a shaped receptacle 1404 to accept a cylindrical (or other shaped) drive 1405. As depicted, the drive 1405 has keys 1406 and 1407 which mate with slots 1408 and 1409 to positively engage and turn the page disk 1401. The drive 1405 has a set of vertical indexing notches 1408 that interface with a biased (such as by a spring) vertical indexing mechanism 1409 which advances the drive downward by one page disk for each page disk that is turned. This provides a page disk drive mechanism that positively engages each page disk to be turned and precisely turns it the desired rotational amount. A cable or motor may be used to control the drive 1405, as desired.

Preferably the housing for the page disks will be made of plastic or other lightweight and low cost material.

The preceding embodiments are considered illustrative of the inventive concepts and are not to be construed as limiting the invention as defined in the claims below. The inventive concepts may be implemented into many physical embodiments in addition to those described above. The claims are intended to encompass the inventive concepts in all of their variations, embodiments and equivalents, and variations of the invention are not to be regarded as a departure from the spirit and scope of the invention.

We claim:

1. A page turner comprising:

a housing having a recess in its interior, a plurality of page disks located within said recess, a plurality of page indexes, each page index being associated with a page disk, a roller in contact with one of said page disks so that rotation of said roller causes rotation of said page disk, and rotation of said page disk causes rotational movement of one of said page indexes associated with said page disk in order to move a page attached to said page index.

2. A page turner as recited in claim 1 further comprising:

a plurality of separator disks located within said recess, said separator disks being placed between two of said page disks in order to isolate page disks from movement caused by contact with another of said page disks.

3. A page turner as recited in claim 1 wherein said page disks comprise a polycarbonate material.

4. A page turner as recited in claim 1 wherein at least one of said page disks is formed in a generally semicircular configuration.

5. A page turner as recited in claim 1 wherein at least one of said page indexes is an integral part of one of said page disks with which it is associated.

6. A page turner as recited in claim 1 wherein at least one of said page indexes is attached to one of said page disks with which it is associated by a protrusion and slot mechanism.

7. A page turner as recited in claim 1 wherein said protrusion is a hook.

8. A page turner as recited in claim 1 wherein said housing has a retractable pin and retractable roller follower that permit a user to insert and remove page disks.

9. A page turner as recited in claim 1 further comprising a mechanism for attaching the page turner to a stationary object.

10. A page turner as recited in claim 1 wherein said housing has a lower housing member and an upper housing member, said upper and lower housing members having a cavity that is capable of receiving a plurality of said page disks; and wherein said lower housing member has a channel located in it for receiving a cable that drives said roller.

11. A page turner as recited in claim 1 further comprising:

a cable having a first end and a second end, said cable first end having said roller attached thereto so that rotation of said cable results in rotation of said roller, said cable second end being driven by a remote actuation mechanism.

12. A page turner as recited in claim 11 wherein said remote actuation mechanism is a foot pedal.

13. A page turner as recited in claim 12 wherein said cable second end is driven by a set of gears moved by a foot pedal.

14. A page turner as recited in claim 12 wherein said cable second end is driven by an electric motor that is turned on by use of said foot pedal.

15. A page turner comprising:

a plurality of page disks arranged into a stack that has a top and a bottom, the stack of said page disks being arranged in a manner that permits a top page disk which is located at the top of said stack to be turned without simultaneously turning any of said page disks beneath said top page disk, a plurality of page indexes, each page index being affixed to one of said page disks, and each of said page indexes being configured to permit attachment to a page of a publication whose pages are to be turned, a page disk turning apparatus that causes one of said page disks in the stack of said page disks to rotate about 160 degrees, and thereby causes the page index affixed to said page disk to also rotate about 160 degrees, the page index in turn causing rotation of a page attached to it.

16. A page turner as recited in claim 15 wherein at least one of said page disks is generally semicircular in shape.

17. A page turner as recited in claim 15 wherein said page indexes are detachable from said page disks.

18. A page turner as recited in claim 16 wherein said page disks each have an outer periphery; and wherein said page turning apparatus comprises a powered roller in contact with the outer periphery of the page disk at the top of the stack of page disks.

19. A page turner as recited in claim 15 wherein said page disks each comprise a receptacle and a slot to accommodate a keyed cylinder; and wherein said page turning apparatus comprises a cylinder with at least one key on its outer surface, and a vertical indexing mechanism, said cylinder being configured to be installable into said page disk receptacles, said key being configured to engage said page disk slots in order to exert a force against one of said slots in order to rotate the page disk associated with that slot, and said vertical indexing mechanism serving to control vertical placement of said cylinder in order to accurately position it with respect to one of said page disks.

20. A page turner comprising:

an upper housing member and a lower housing member, said upper and lower housing members being assembleable together in order to form a housing, the housing having a cavity in its interior that is capable of housing a plurality of page disks, a stack of said page disks locatable in said cavity, said stack having a top and a bottom, each of said page disks being formed in a generally semicircular shape, each of said page disks having a page index protruding at approximately a right angle from it in the general direction of the bottom of said stack of said page disks, and each of said disks being configured and arranged to rotate about the same axis, a plurality of separator disks, each separator disk being locatable in said stack of said page disks, said separator disks being configured to isolate one of said page disks being rotated from other of said page disks in said stack of said page disks, so that only one of said page disks rotates at a time, a drive cable having a proximal end and a distal end, said drive cable proximal end including a disk roller, said drive cable proximal end being installable in said housing so that said disk roller contacts one of said page disks at the top of said stack of said page disks, a remotely locatable actuation mechanism, said drive cable distal end being attachable to said actuation mechanism, and said actuation mechanism being actuatable so that a rotational energy is transmitted through said drive cable from said actuation mechanism to said disk roller, causing said disk roller to roll against a page disk and thereby cause rotation of that page disk.

* * * * *